US011396775B2

(12) United States Patent
Peters

(10) Patent No.: US 11,396,775 B2
(45) Date of Patent: Jul. 26, 2022

(54) ROTARY STEERABLE DRILLING ASSEMBLY WITH A ROTATING STEERING DEVICE FOR DRILLING DEVIATED WELLBORES

(71) Applicant: Volker Peters, Wienhausen (DE)

(72) Inventor: Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/945,586

(22) Filed: Jul. 31, 2020

(65) Prior Publication Data

US 2020/0362637 A1 Nov. 19, 2020

Related U.S. Application Data

(63) Continuation-in-part of application No. 15/210,669, filed on Jul. 14, 2016, now Pat. No. 10,731,418.

(51) Int. Cl.
*E21B 7/06* (2006.01)
*E21B 17/10* (2006.01)
(Continued)

(52) U.S. Cl.
CPC ..... *E21B 7/067* (2013.01); *E21B 3/00* (2013.01); *E21B 12/00* (2013.01); *E21B 17/1078* (2013.01); *E21B 10/00* (2013.01)

(58) Field of Classification Search
CPC ..... E21B 7/067; E21B 17/04
See application file for complete search history.

(56) References Cited

U.S. PATENT DOCUMENTS 2,971,770 A 2/1961 Wagner
3,743,034 A * 7/1973 Bradley ..... E21B 7/06 175/61

(Continued)

FOREIGN PATENT DOCUMENTS

WO 03052236 A1 6/2003
WO 03052237 A1 6/2003
WO 2015102584 A1 7/2015

OTHER PUBLICATIONS

PCT International Search Report and Written Opinion; International Application No. PCT/US2017/041632; International Filing Date: Jul. 12, 2017; dated Sep. 22, 2017; pp. 1-13.

(Continued)

*Primary Examiner* — Shane Bomar
(74) *Attorney, Agent, or Firm* — Cantor Colburn LLP

(57) ABSTRACT

A drilling assembly and method of drilling a wellbore is disclosed. The drilling assembly includes a steering device having a tilt device and an actuation device. A first section and a second section of the drilling assembly are coupled through the tilt device, wherein the first section is attached to a drill bit. The actuation device includes an electromechanical actuator and causes a tilt of the tilt device to cause the first section attached to the drill bit and the drill bit to tilt relative to the second section. The wellbore is drilled using the drill bit. The electromechanical actuator is actuated to tilt the tilt device to cause the first section attached to the drill bit and the drill bit to tilt relative to the second section and to maintain the tilt geostationary while the drilling assembly is rotating to form a deviated section of the wellbore.

20 Claims, 14 Drawing Sheets

(51) Int. Cl.

| | |
|---|---|
| ***E21B 3/00*** | (2006.01) |
| ***E21B 12/00*** | (2006.01) |
| *E21B 10/00* | (2006.01) |

(56) References Cited

U.S. PATENT DOCUMENTS

| | | | | |
|---|---|---|---|---|
| 3,941,197 | A * | 3/1976 | Stinson | E21B 10/56 175/400 |
| 4,703,814 | A * | 11/1987 | Nguyen | E21B 10/62 175/393 |
| 4,974,688 | A | 12/1990 | Helton | |
| 5,671,816 | A | 9/1997 | Tibbitts | |
| 6,092,610 | A | 7/2000 | Kosmala et al. | |
| 6,109,372 | A * | 8/2000 | Dorel | E21B 47/08 175/61 |
| 6,158,529 | A * | 12/2000 | Dorel | E21B 7/067 175/61 |
| 6,837,315 | B2 | 1/2005 | Pisoni et al. | |
| 7,188,685 | B2 | 3/2007 | Downton et al. | |
| 7,360,609 | B1 * | 4/2008 | Falgout, Sr. | E21B 7/067 166/237 |
| 7,762,356 | B2 | 7/2010 | Turner et al. | |
| 7,802,637 | B2 | 9/2010 | Aronstam et al. | |
| 8,469,117 | B2 | 6/2013 | Pafitis et al. | |
| 8,590,636 | B2 | 11/2013 | Menger | |
| 8,763,725 | B2 | 7/2014 | Downton | |
| 9,057,223 | B2 | 6/2015 | Perrin et al. | |
| 9,828,804 | B2 * | 11/2017 | Pearce | E21B 7/067 |
| 10,871,033 | B2 * | 12/2020 | Bhosle | E21B 7/06 |
| 11,174,681 | B2 * | 11/2021 | Hardin, Jr. | E21B 4/006 |
| 2003/0127252 | A1 | 7/2003 | Downton et al. | |
| 2009/0008151 | A1 | 1/2009 | Turner et al. | |
| 2009/0032302 | A1 * | 2/2009 | Downton | E21B 7/067 175/38 |
| 2009/0166089 | A1 * | 7/2009 | Millet | E21B 7/067 175/61 |
| 2009/0272579 | A1 | 11/2009 | Sihler et al. | |
| 2010/0108380 | A1 * | 5/2010 | Teodorescu | E21B 44/00 175/24 |
| 2011/0100716 | A1 | 5/2011 | Shepherd | |
| 2011/0284292 | A1 | 11/2011 | Gibb et al. | |
| 2012/0018225 | A1 * | 1/2012 | Peter | E21B 7/067 175/61 |
| 2012/0043133 | A1 | 2/2012 | Millett | |
| 2013/0341095 | A1 * | 12/2013 | Perrin | E21B 47/01 175/45 |
| 2013/0341098 | A1 | 12/2013 | Perrin et al. | |
| 2014/0110178 | A1 | 4/2014 | Savage et al. | |
| 2014/0182941 | A1 | 7/2014 | Oppelaar | |
| 2014/0209389 | A1 | 7/2014 | Sugiura et al. | |
| 2015/0114719 | A1 * | 4/2015 | Pearce | E21B 7/04 175/61 |
| 2016/0108679 | A1 * | 4/2016 | Bayliss | E21B 7/068 175/45 |
| 2016/0298392 | A1 * | 10/2016 | Gajji | E21B 7/067 |
| 2017/0044834 | A1 | 2/2017 | Peters | |
| 2017/0314389 | A1 | 11/2017 | Peters et al. | |
| 2018/0016844 | A1 | 1/2018 | Peters | |
| 2018/0016845 | A1 | 1/2018 | Peters | |
| 2018/0016846 | A1 * | 1/2018 | Peter | E21B 47/12 |
| 2020/0300042 | A1 * | 9/2020 | Peters | E21B 7/067 |
| 2020/0392792 | A1 * | 12/2020 | Peters | E21B 7/068 |

OTHER PUBLICATIONS

PCT International Search Report and Written Opinion; International Application No. PCT/US2017/041634; International Filing Date: Jul. 12, 2017; dated Sep. 26, 2017; pp. 1-13.

PCT International Search Report and Written Opinion; International Application No. PCT/US2017/041635; International Filing Date: Jul. 12, 2017; dated Sep. 22, 2017; pp. 1-13.

* cited by examiner

ROTARY STEERABLE DRILLING ASSEMBLY WITH A ROTATING STEERING DEVICE FOR DRILLING DEVIATED WELLBORES

CROSS REFERENCES TO RELATED APPLICATIONS

The present application claims priority to U.S. application Ser. No. 15/210,669, filed Jul. 14, 2016, the contents of which are incorporated herein by reference in their entirety.

BACKGROUND

1. Field of the Disclosure

The disclosure relates generally to rotary drilling systems for drilling of deviated wellbores and particularly to a drilling assembly that utilizes a rotating steering device for drilling deviated wellbores.

2. Background Art

Wells or wellbores are formed for the production of hydrocarbons (oil and gas) from subsurface formation zones where such hydrocarbons are trapped. To drill a deviated wellbore, a drilling assembly (also referred to as a bottom-hole assembly or "BHA") that includes a steering device coupled to the drill bit is used. The steering device tilts a lower portion of the drilling assembly by a selected amount and along a selected direction to form the deviated portions of the wellbore. Various types of steering devices have been proposed and used for drilling deviated wellbores. The drilling assembly also includes a variety of sensors and tools that provide a variety of information relating to the earth formation and drilling parameters.

In one such steering device, an actuator mechanism is used in which a rotary valve diverts the mud flow towards a piston actuator, while the entire tool body, together with the valve, is rotating inside the wellbore. In such a mechanism, the valve actuation is controlled with respect to the momentary angular position inside the wellbore (up, down, left, right). A control unit maintains a rotary stationary position (also referred to as geostationary) with respect to the wellbore. As an example, if, during drilling, the drill string and thus the drilling assembly rotates at 60 rpm clockwise, the control unit rotates at 60 rpm counterclockwise, driven by, for example, an electric motor. To maintain a rotary stationary position, the control unit may contain navigational devices, such as accelerometer and a magnetometer. In such systems, the actuation force relies on the pressure drop between the pressure inside the tool and the annular pressure outside the tool. This pressure drop is highly dependent on operating parameters and varies over a wide range. The actuation stroke is a reaction based upon the pressure force exerted onto the actuation pistons. Neither force nor stroke is precisely controllable.

The disclosure herein provides a drilling system that utilizes a steering device that utilizes actuators that rotate along with the drilling assembly to drill deviated wellbores.

SUMMARY

In one aspect, a drilling assembly for use in drilling of a wellbore is disclosed. The drilling assembly includes a steering device having a tilt device and an actuation device, wherein a first section and a second section of the drilling assembly are coupled through the tilt device and wherein the first section is attached to a drill bit. The actuation device comprises an electromechanical actuator and causes a tilt of the tilt device to cause the first section attached to the drill bit and the drill bit to tilt relative to the second section along a selected first direction while the steering unit is rotating.

In another aspect, a method of drilling a wellbore is disclosed. A drilling assembly is conveyed in the wellbore. The drilling assembly includes a drill bit at an end thereof, a steering unit that includes a tilt device and an actuation device, wherein a first section and a second section of the drilling assembly are coupled through the tilt device and wherein the first section is attached to the drill bit, and wherein the actuation device comprises an electromechanical actuator and tilts the tilt device to cause the first section attached to the drill bit and the drill bit to tilt relative to the second section about the tilt device along a selected direction while the steering unit is rotating. The wellbore is drilled using the drill bit. The electromechanical actuator is actuated to tilt the tilt device to cause the first section attached to the drill bit and the drill bit to tilt relative to the second section and to maintain the tilt geostationary while the drilling assembly is rotating to form a deviated section of the wellbore.

Examples of the certain features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
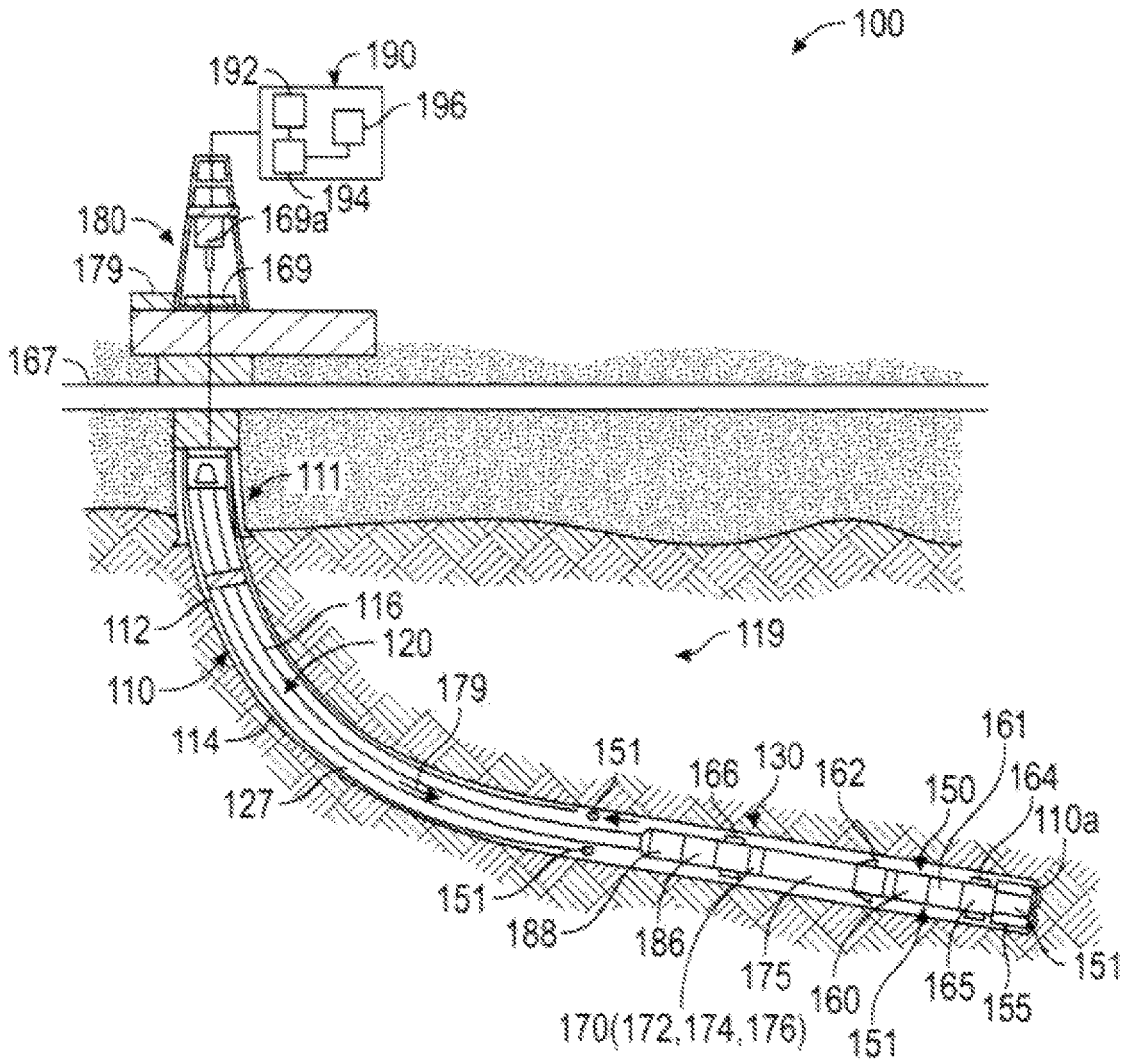
FIG. 1 shows a schematic diagram of an exemplary drilling system that may utilize a steering unit for drilling deviated wellbores, according to one non-limiting embodiment of the disclosure.

FIG. 1 is a schematic diagram of an exemplary rotary steerable drilling system 100 that utilizes a steering device (also referred to as steering unit or steering assembly) in a drilling assembly for drilling vertical and deviated wellbores and maintain the steering device geostationary or substantially geostationary while the steering device is rotating. A deviated wellbore is any wellbore that is non-vertical. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 that carries a drilling assembly 130 (also referred to as the "bottomhole assembly" or "BHA") at its bottom end. The tubular member 116 may be a drill pipe made up by joining pipe sections. The drilling assembly 130 is coupled to a disintegrating device, such as a drill bit 155) or another suitable cutting device, attached to its bottom end. The drilling assembly 130 also includes a number of devices, tools and sensors, as described below. The drilling assembly 130 further includes a steering device 150 to steer a section of the drilling assembly 130 along any desired direction, a methodology often referred to as geosteering. The steering device 150, in one non-limiting embodiment, includes a tilt device 161 and an actuation device 160 (for example, an electro-mechanical device or a hydraulic device) that tilts one section, such as the lower section 165 of the drilling assembly 130, relative to another section, such as the upper section 166 of the drilling assembly 130. The lower section 165 is coupled to the drill bit 155. In general, the actuation device tilts the tilt device 161, which in turn causes the lower section 165 and thus the drill bit 155 to tilt or point a selected extent along a desired or selected direction, as described in more detail in reference to FIGS. 2-6.

Still referring to FIG. 1, the drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the tubular member 116 may be utilized to rotate the drill string 120 and the drilling assembly 130. A control unit (also referred to as a "controller" or "surface controller") 190, which may be a computer-based system, at the surface 167 may be utilized for receiving and processing data transmitted by various sensors and tools (described later) in the drilling assembly 130 and for controlling selected operations of the various devices and sensors in the drilling assembly 130, including the steering device 150. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those of drilling of the wellbore 110. The data storage device 194 may be any suitable device, including, but not limited to, a read-only memory (ROM), a random-access memory (RAM), a flash memory, a magnetic tape, a hard disc and an optical disk. To drill the wellbore 110, a drilling fluid 179 is pumped under pressure into the tubular member 116, which fluid passes through the drilling assembly 130 and discharges at the bottom 110*a* of the drill bit 155. The drill bit 155 disintegrates the formation rock into cuttings 151. The drilling fluid 179 returns to the surface 167 along with the cuttings 151 via annular space 127 (also referred as the "annulus") between the drill string 120 and the wellbore 110.

Still referring to FIG. 1, the drilling assembly 130 may further include one or more downhole sensors (also referred to as the measurement-while-drilling (MWD) sensors and logging-while-drilling (LWD) sensors or tools, collectively referred to as downhole devices 175, and at least one control unit or controller 170 for processing data received from the downhole devices 175. The downhole devices 175 may include sensors for providing measurements relating to various drilling parameters, including, but not limited to, vibration, whirl, stick-slip, flow rate, pressure, temperature, and weight-on-bit. The drilling assembly 130 further may include tools, including, but not limited to, a resistivity tool, an acoustic tool, a gamma ray tool, a nuclear tool and a nuclear magnetic resonance tool. Such devices are known in the art and are thus not described herein in detail. The drilling assembly 130 also includes a power generation device 186 and a suitable telemetry unit 188, which may utilize any suitable telemetry technique, including, but not limited to, mud pulse telemetry, electromagnetic telemetry, acoustic telemetry and wired pipe. Such telemetry techniques are known in the art and are thus not described herein in detail. Drilling assembly 130, as mentioned above, includes the steering device 150 that enables an operator to steer the drill bit 155 in desired directions to drill deviated wellbores when the drilling assembly is rotating and to maintain the steering device geostationary or substantially geostationary. Stabilizers, such as stabilizers 162 and 164 are provided along the lower section 165 and the upper section 166 to stabilize the steering device 150 and the drill bit 155. Additional stabilizers may be used to stabilize the drilling assembly 130. The controller 170 may include a processor 172, such as a microprocessor, a data storage device 174, such as a solid-state memory, and a program 176 accessible to the processor 172. The controller 170 communicates with the surface controller 190 to control various functions and operations of the tools and devices in the drilling assembly. During drilling, the steering device 150 controls the tilt and direction of the drill bit 155, as described in more detail in reference to FIGS. 2-6.

Figure 2:
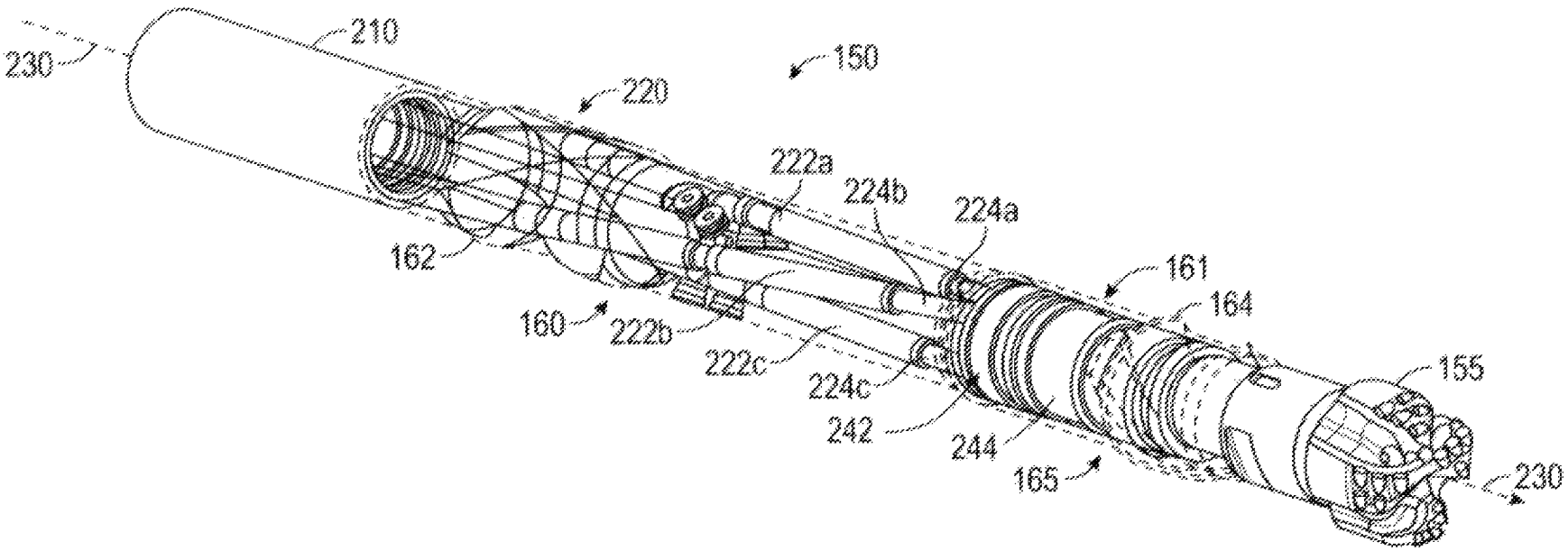
FIG. 2 shows an isometric view of certain elements of an electro-mechanical steering device coupled to a drill bit for drilling deviated wellbores, according to a non-limiting embodiment of the disclosure.

FIG. 2 shows an isometric view of certain elements or components of the steering device 150 for use in a drilling assembly, such as drilling assembly 130 of FIG. 1, to steer or tilt the drill bit 155 for drilling deviated wellbores, according to one non-limiting embodiment of the disclosure. The drilling assembly 130 includes a collar or housing 210 for housing the various elements or components of the steering device 150. The steering device 150 includes a tilt device 161 and an actuation device 160 for tilting the lower section 165 with respect the upper section 166. In one non-limiting embodiment, the tilt device 161 includes an adjuster 242 and a joint 244. The upper section 166 and the lower section 165 are coupled by the joint 244. The adjuster 242 is coupled to the joint 244 in a manner such that when the adjuster 242 is moved a certain amount along a certain direction, it causes the joint 244 to tilt accordingly. The tilt device 161 can be tilted by the actuation device 160 along any direction and by any desired amount to cause the lower section 165 and thus the drill bit 155 to point in any desired direction about a selected point or location in the drilling assembly 130. The adjuster 242 may be a swivel or another suitable device. The joint 244 may be one of a Cardan joint, homokinetic joint, constant velocity joint, universal joint, knuckle joint, Hooke's joint, u-joint or another suitable device. The joint 244 transfers axial and torsional loads between the upper section 166 and the lower section 165, while maintaining angular flexibility between the two sections. Stabilizers 162 and 164 are disposed at suitable locations around the steering device 150, such as one around the lower section 165 and the other around the upper section 166, to provide stability to the steering device 150 and the drill bit 155 during drilling operations. In one non-limiting embodiment, the actuation device 160 further includes a suitable number, such as three or more, of electro-mechanical actuators, such as actuators 222*a*, 222*b* and 222*c*, radially arranged spaced apart in the actuation device 160. Each such actuator is connected to a corresponding end 342*a*-342*c* (FIG. 3) of the adjuster 242. In one embodiment, each actuator is a longitudinal device having a lower end that can be extended and retracted to apply a desired force on the adjuster substantially parallel to a longitudinal axis 230 to cause the adjuster 242 to move about the longitudinal axis 230 of the steering device 150. In FIG. 2, ends 224*a*-224*c* of actuators 222*a*-222*c* are shown directly connected respectively to the ends or abutting elements of the adjuster 242. As described in reference to FIG. 1, the steering device 150 is part of the drilling assembly 130. During drilling, as the drilling assembly 130 rotates, the steering device 150 and thus each actuator rotates therewith. Each actuator 222*a*-222*c* is configured to apply force on the adjuster 242, as described later, and depending upon the forces applied, the movement of the adjuster 242 causes the lower section 165 and thus the drill bit 155 to tilt along a desired direction. In the embodiment shown in FIG. 3, since the actuators 222*a*-222*c* are mechanically connected to their corresponding adjuster ends 342*a*-342*c*, the forces applied by such actuators and their respective strokes may be synchronized to create any desired steering direction. Although, the actuators 222*a*-222*c* shown apply axial forces on the adjuster 242, any other suitable device, including, but not limited to a rotary oscillating device, may be utilized to apply forces on the adjuster 242. In aspects, movement of at least a part the electro-mechanical actuation unit 220 may be selectively adjusted or limited (mechanically, such as by providing a stop in the steering device or electronically by a controller) to cause the lower section 165 to tilt with a selected tilt relative to the upper section 166. Also, the tilt of the joint 244 may be selectively adjusted or limited to cause the lower section 165 to tilt with a selected tilt relative to the upper section 166.

Figure 3:
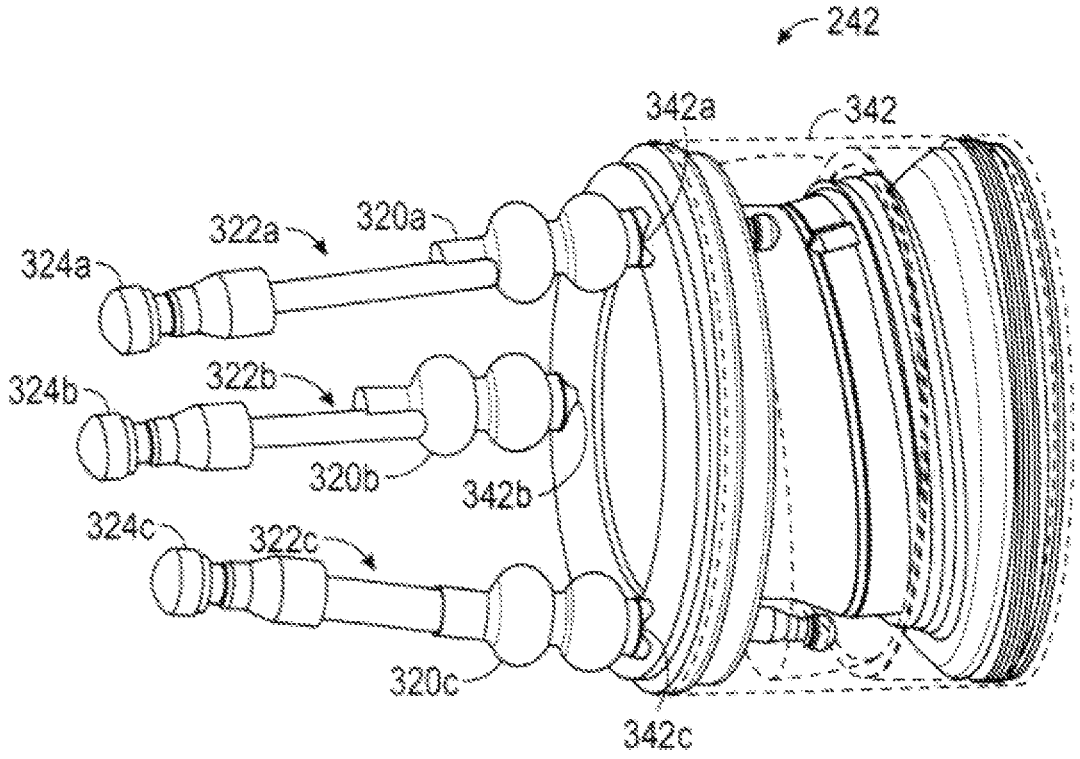
FIG. 3 shows an isometric view of a non-limiting embodiment of an adjuster for use in the steering unit of FIG. 2.

FIG. 3 shows an isometric view of non-limiting embodiment of an adjuster 242 for use in the steering device 150 of FIG. 2. Referring to FIGS. 2 and 3, the adjuster 242 includes a cylindrical body 342 and a number of spaced apart abutting elements or members, such as connectors 322*a*, 322*b* and 322*c*, with connector 322*a* having one end 320*a* connected to the adjuster end 342*a* and the other end 324*a* for a direct connection to the actuator 222*a*, connector 322*b* having one end 320*b* connected to the adjuster end 342*b* and the other 324*b* for direct connection to the actuator 222*b*, and connector 322*c* having one end 320*c* connected to adjuster end 342*c* and the other end 324*c* for direct connection to the actuator 222*c*. The abutting elements may include elements such as a cam, a crank shaft; an eccentric member; a valve; a ramp element; and a lever. In this configuration, when forces are applied onto the adjuster 242 by the actuators, the adjuster 242 may create an eccentric offset in real time in any desired direction by any desired amount about the longitudinal axis 230, which provides 360 degrees of drill bit maneuvering ability during drilling. The forces on the connectors 322*a*-322*c* create a substantially geostationary tilt of the tilt device 161. In an alternative embodiment, the adjuster 242 may be a hydraulic device that causes the joint 244 to tilt the lower section 165 relative to the upper section 166, as described in more detail in reference to FIG. 6.

Figure 4:
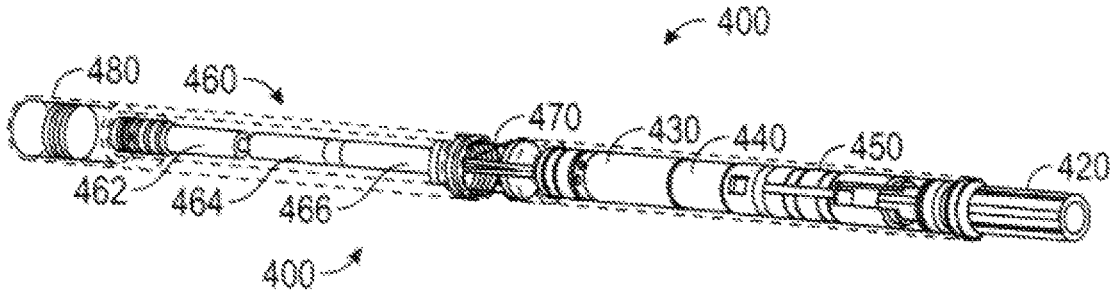
FIG. 4 shows certain elements of a modular electromechanical actuator for use in the steering unit of FIG. 2, according to a non-limiting embodiment of the disclosure.

FIG. 4 shows certain elements or components of an actuator 400 for use as any of the actuators 222*a*-222*c* in the steering device 150 of FIG. 2. In one aspect, the actuator 400 is a unitary device that includes a movable end 420 that may be extended and retracted. The actuator 400 further includes an electric motor 430 that may be rotated in clockwise and anticlockwise directions. The electric motor 430 drives a gear box 440 (clockwise or anti-clockwise) that in turn rotates a drive screw 450 and thus the movable end 420 axially in either direction. The actuator 400 further includes a control circuit 460 that controls the operation of the electric motor 430. The control circuit 460 includes electrical circuits 462 and may include a microprocessor 464 and memory device 466 that houses instructions or programs for controlling the operation of the electric motor 430. The control circuit 460 is coupled to the electric motor 430 via conductors through a bus connector 470. In aspects, the actuator 400 may also include a compression piston device or another suitable device 480 for providing pressure compensation to the actuator 400. Each such actuator may be a unitary device that is inserted into a protective housing disposed in the steering device 150 (FIG. 1), as described in reference to FIG. 5. During drilling, each such actuator is controlled by its control circuit, which circuit may communicate with the controller 170 (FIG. 1) and/or surface controller 190 (FIG. 1) to exert force on the adjuster 242 (FIG. 2).

Figure 5:
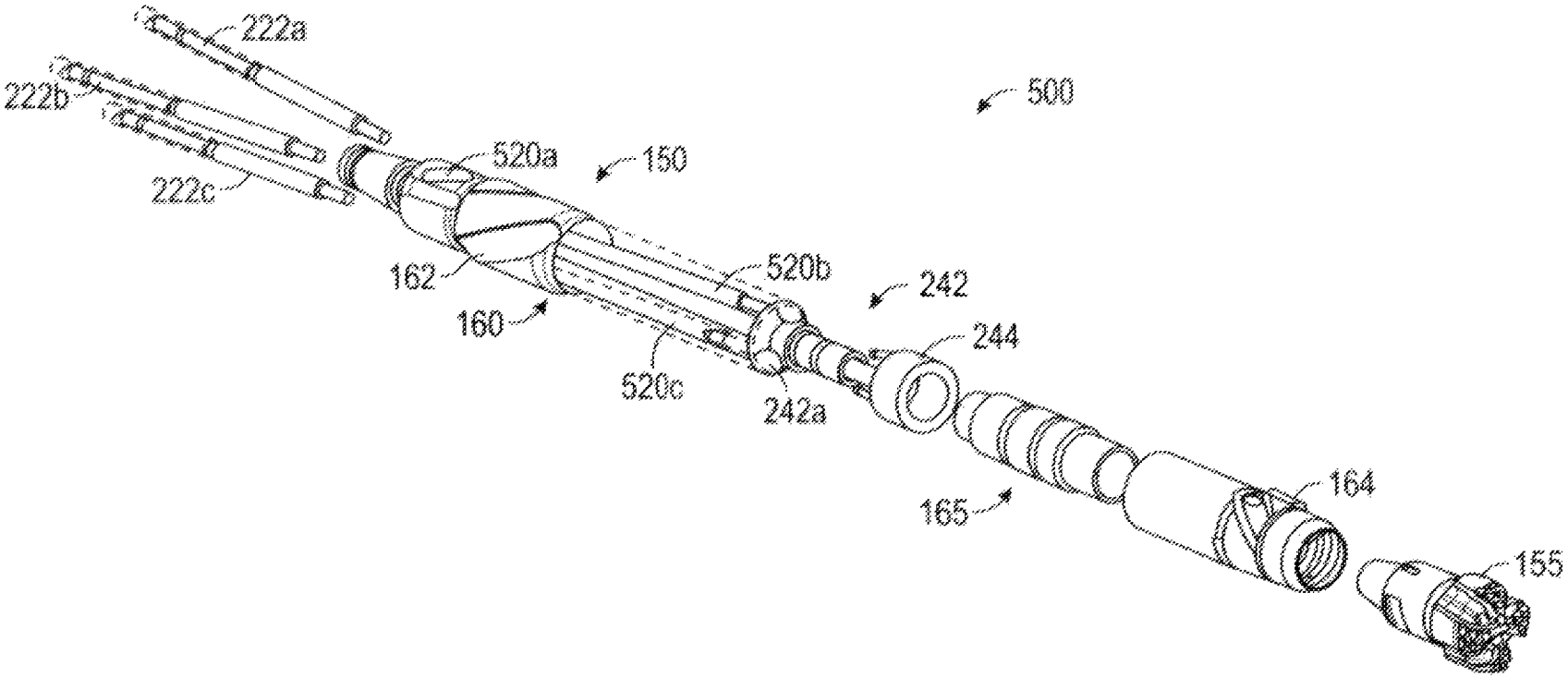
FIG. 5 shows an isometric view of components of the steering unit laid out for assembling the steering unit of FIG. 2.

FIG. 5 shows an isometric view 500 of components of the steering device 150 of FIG. 2 laid out for assembling the steering device 150. As described earlier, the steering device 150 includes an upper section 166, a lower section 165, an adjuster 242 and a joint 244 between the upper section 166 and the lower section 165. The upper section 166 includes bores or pockets 520*a*, 520*b* and 520*c*, corresponding to each of the individual actuators, such as actuators 222*a*-222*c*. The actuator 222*a* is inserted into the bore or pocket 520*a*, actuator 222*b* into bore or pocket 520*b* and actuator 222*c* into bore or pocket 520*c*. The actuators 222*a*-222*c* are connected to the upper ends 342*a*-342*c* of the adjuster 242 as described above in reference to FIGS. 2 and 3. The adjuster 242 is connected to the lower section 165 by means of the joint 244 to complete the steering device. The steering device 150 is connected to the drill bit 155.

Figure 6:
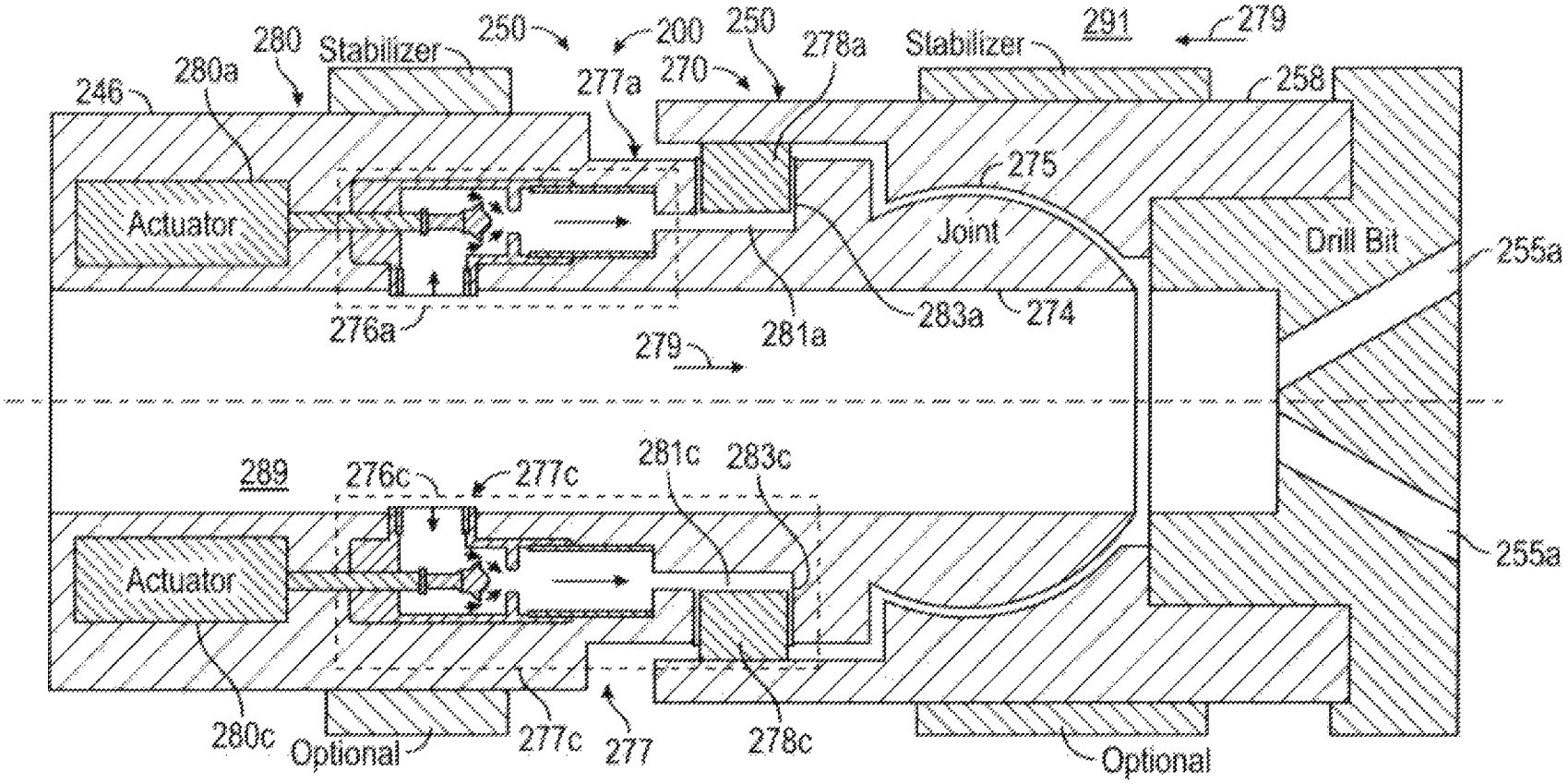
FIG. 6 is a block diagram of a drilling assembly that utilizes a steering device having an actuation de vice and a hydraulic force application device, according to a non-limiting embodiment of the disclosure.

FIG. 6 is a block diagram of a drilling assembly 200 that utilizes a steering device 250 that includes an actuation device 280 and a tilt device 270. The actuation device 280 shown is the same as shown in FIG. 2 and includes three or more actuators 280*a*-280*c* disposed in a housing 210. The tilt device 270 includes an adjuster 277 and a joint 274. In one non-limiting embodiment, the adjuster 277 includes a separate hydraulic force application device corresponding to each of the actuators 280*a*-280*c*. In FIG. 2, force application devices 277*a*-277*c* respectively correspond to and are connected to actuators 280*a*-280*c*. The actuators 280*a*-280*c* selectively operate their corresponding force application devices 277*a*-277*c* to tilt the lower section 258 relative to the upper section 246 about the joint 274 when the drilling assembly 200 and thus the steering device 250 is rotating. In one non-limiting embodiment, each of the force application devices 277*a*-277*c* includes a valve in fluid communication with pressurized drilling fluid 279 flowing through channel 289 in the drilling assembly 200 and a chamber that houses a piston. In the embodiment of FIG. 6, force application devices 277*a*-277*c* respectively include valves 276*a*-276*c* and pistons 278*a*-278*c* respectively disposed in chambers 281*a*-281*c*. During drilling, the steering device 250 rotates while the pressurized drilling fluid 279 flows through channel 289 and exits through the passages or nozzles 255*a* in the drill bit 255. The exiting fluid 279*a* returns to the surface via annulus 291, which creates a pressure drop between the channel 289 and the annulus 291. In aspects, the disclosure herein utilizes such a pressure drop to activate the hydraulic force application devices 277*a*-277*c* to create a desired tilt of the lower section 258 relative to the upper section 246 about the joint 274 and to maintain such tilt geostationary or substantially geostationary while the steering device 250 is rotating. To tilt the drill bit 255 via the lower section 258 and upper section 246, the actuators 280*a*-280*c* selectively open and close their corresponding valves 276*a*-276*c*, allowing the pressurized drilling fluid 279 from channel 289 to flow to the cylinders 281*a*-281*c* to extend pistons 278*a*-278*c* radially outward, which apply desired forces on the adjuster 277 to tilt the lower section 258 and thus the drill bit 255 along a desired direction. Each piston and cylinder combination may include a gap, such as gap 283*a* between piston 278*a* and cylinder 281*a* and gap 283*c* between piston 278*c* and chamber 281*c*. Such a gap allows the fluid entering a chamber to escape from that chamber into the annulus 291 when the valve is open and the piston is forced back into its cylinder. Alternatively, one or more nozzles or bleed holes (not shown) connected between the cylinder and the annulus 291 may be provided to allow the fluid to flow from the chamber into the annulus 291. To actively control the tilt of the lower section 258 while the rotary steerable drilling assembly 200 is rotating, the three or more valves 276*a*-276*c* may be activated sequentially and preferably with the same frequency as the rotary speed (frequency) of the drilling assembly 200, to create a geostationary tilt between the upper section 246 and the lower section 258. For instance, referring to FIG. 6, if an upward drilling direction is desired, the actuator 280*c* is momentarily opened, forcing the piston 278*c* to extend outward. At the same moment, actuator 280*a* would close valve 276*a*, blocking pressure from the channel 289 to the piston 278*a*. Since all pistons 276*a*-276*c* are mechanically coupled through the joint 274, piston 278*a* would return or retract upon the outboard stroke of piston 278*c*. When the drilling assembly 200 rotates, e.g. by 180° and for the case of four actuators distributed equi-spaced around the circumference of the drilling assembly 200, the activation would reverse, actuator 280*a* opening valve 276*a* and actuator 280*c* closing valve 276*c*, thus maintaining a geostationary tilt direction. Similar methods may be utilized to tilt and maintain the tilt geo stationary for the embodiment shown in FIG. 2.

Referring to FIGS. 1-6, the steering device 150 described herein is in the lower portion of a drilling assembly 130 (FIG. 1) of a rotary drilling system 100. The steering device 150 includes an adjuster and a joint connected to an actuation device that maneuvers or tilts the adjuster about a drilling assembly axis, which in turn tilts the joint. The joint tilts a lower section containing the drill bit relative to an upper section of the drilling assembly. The system transmits torque from a collar to the drill bit. In one non-limiting embodiment, the adjuster is actively tilted by a selected number of intermittently activated electro-mechanical actuators. The actuators rotate with the drilling assembly and are controlled by signal inputs from one or more position sensors in the drilling assembly 130. Any suitable directional sensors, including, but not limited to magnetometers, accelerometer and gyroscopes may be utilized. Such sensors provide real time position information relating to the wellbore orientation while drilling. Depending on the type and the design of the adjuster the actuators may perform reciprocating or rotary oscillating movement, e. g., actuators coupled to a cam or crank system further enabling the eccentric offset in any desired direction from the drilling assembly axis during each revolution of the drilling assembly, creating a geostationary force and offset of the adjuster axis.

The drilling system 100 disclosed herein does not require a control unit to counter-rotate the tool body rotation. The modular activators positioned in the outer diameter of the actuation assembly receive command signals from a controller located in another section of the tool or higher up in the drilling assembly that may also include navigational sensors. These navigational sensors rotate with the drilling assembly. Such a mechanism can resolve and process the rotary motion of the drilling assembly to calculate momentary angular position (while rotating) and generate commands to the individual actuators substantially instantaneously. As an example, assume the drilling assembly rotates at ⅓ revolutions per second (20 rpm). The current steering vector is intended to point upwards. Assuming the side force element increases eccentricity with positive displacement of the actuation units, the navigational package electronics determine the momentary angular position of the drilling assembly or the steering unit with respect to the earthen formation and sends commands to all of the actuators (stroke and force). At time zero second, one of the actuators (for example the lowermost) receives a command to stroke outward a certain distance. At time 1 second, the steering unit has rotated 120 degrees and the same actuator receives the command to decrease the stroke to approximately to the middle position. At time 1.5 seconds, this actuator is at the uppermost position and the navigational package electronics sends a command to further decrease the stroke of a similar value as sent at zero second, but negative from a middle position. The commands are constantly sent to each actuator with their respective stroke requirements. With the changes for the stroke of the actuators, the angular tilt can be controlled and adjusted in real time. In such a configuration, each actuator performs one stroke per tool revolution (positive and negative from the middle position). To drill a straight wellbore section, all actuators are maintained stationary at their respective middle positions, thus requiring only minimum energy supply to hold the centralized position. The amount of the tilt angle and the momentary direction of the tilt angle controls the drilling direction of the wellbore.

Figure 7:
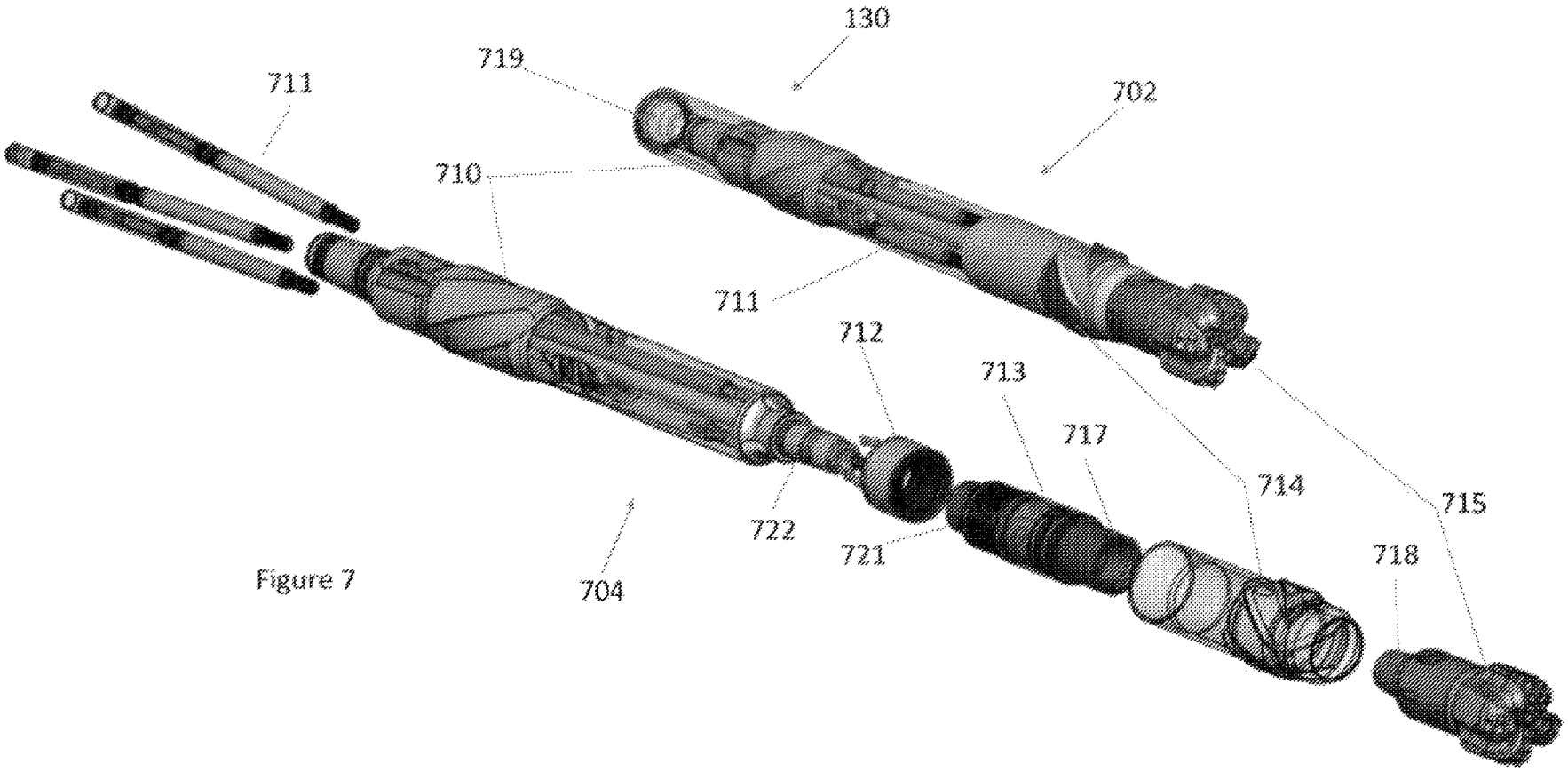
FIG. 7 shows both an assembled view and an exploded view of the drilling assembly for drilling deviated wellbore.
Figure 8:
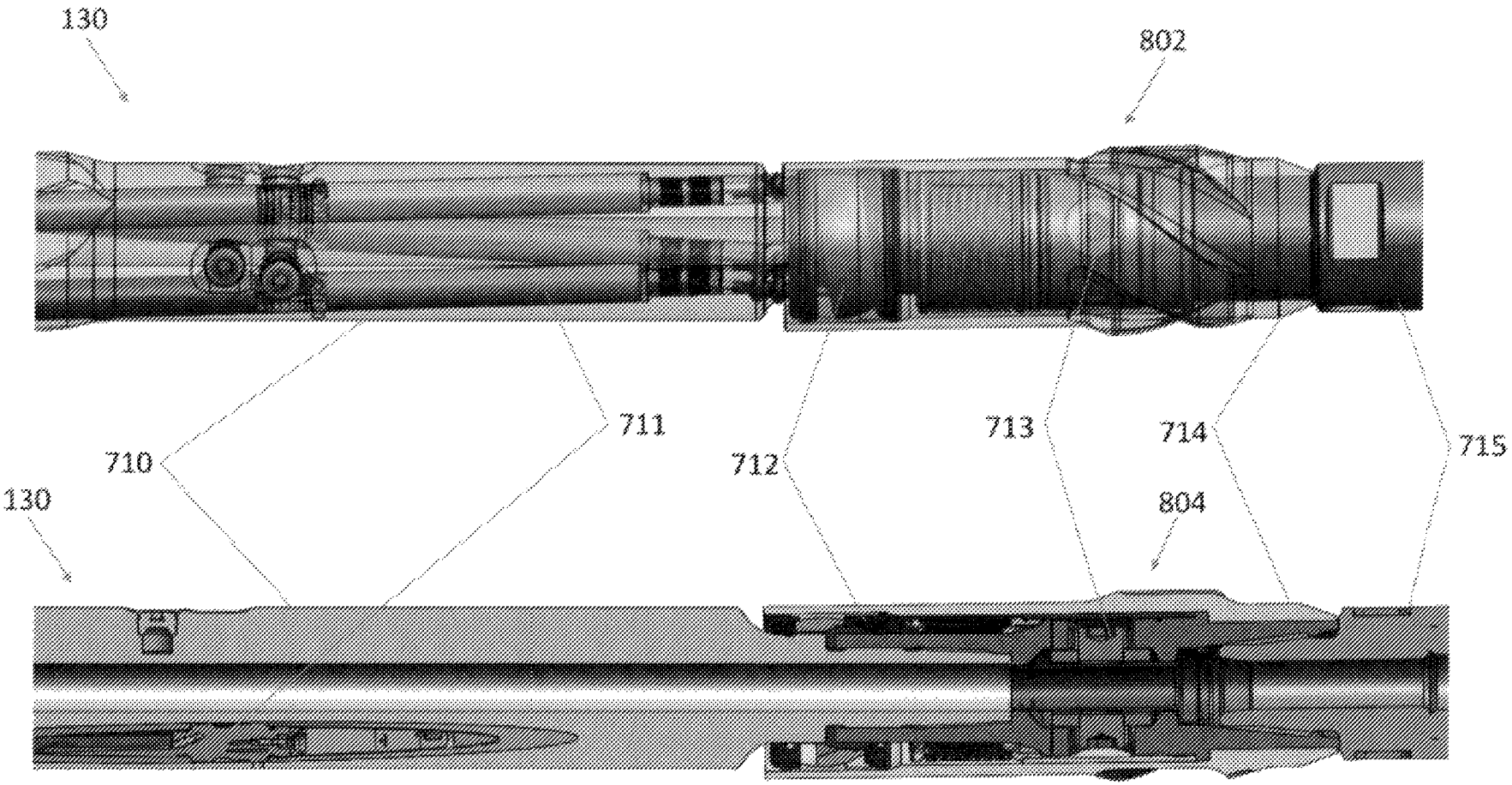
FIG. 8 shows both a side view and a cross-sectional view of the drilling assembly in a non-actuated configuration.

FIG. 7 shows both an assembled view 702 and an exploded view 704 of the drilling assembly 130 for drilling deviated wellbores. FIG. 8 shows both a side view 802 and a cross-sectional view 804 of the drilling assembly 130 in a non-actuated configuration. The outer components of the drilling assembly 130 are made transparent to reveal the internal components. The drilling assembly 130 includes an upper housing 710 having a string connector 719 on its upper or uphole end for attaching the upper housing 710 to uphole segments or tools of the BHA. The upper housing 710 further includes a shoulder thread 722 at its lower or downhole end. A drill bit 715 is coupled to the downhole end of the upper housing 710 via a joint 713 that is placed between the upper housing 710 and the drill bit 715. The drill bit 715 connects to one end of the joint 713 and the upper housing 710 connects to an opposite end of the joint 713.

The joint 713 includes a box thread 717 at its downhole end and a box thread 721 at its uphole end. The drill bit includes a drill bit thread 718. The drill bit 715 is mechanically fastened to the joint 713 by threadingly attaching drill bit thread 718 to box thread 717. The joint 713 is mechanically fastened to the upper housing by threadingly attaching the box thread 721 to shoulder thread 722. A stabilizer 714 is clamped or bracketed between the joint 713 and the drill bit 715 and circumferentially surrounds drill bit thread 718 and box thread 717. Similarly, an adjuster 712 is clamped or bracketed between the upper housing 710 and the joint 713 and circumferentially surrounds box thread 721 and shoulder thread 722. One or more electromechanical actuators 711 extend through bores in the upper housing 710. The electromechanical actuators 711 are linked to the adjuster 712 once the drilling assembly is in its assembled state. The adjuster 712 receives forces applied via the electromechanical actuators 711 to adjust an angle at the joint 713.

Figure 9:
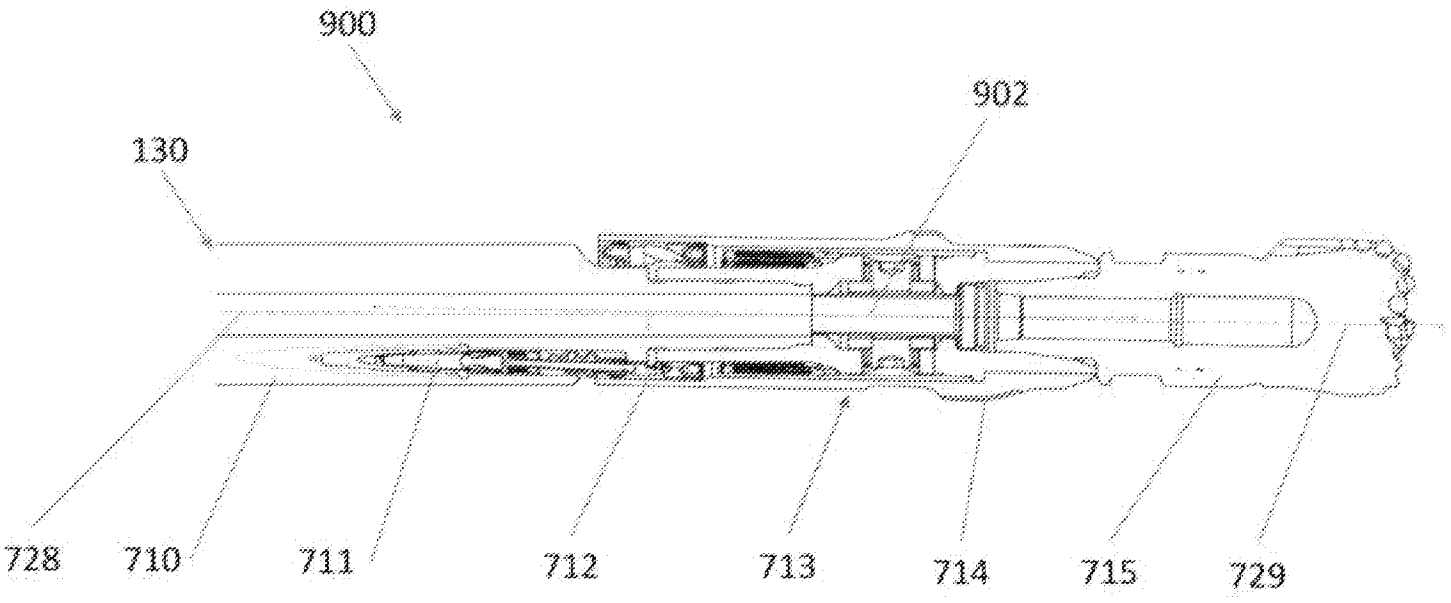
FIG. 9 shows a cross-section view of the drilling assembly in an actuated configuration.

FIG. 9 shows a cross-section view 900 of the drilling assembly 130 in an actuated configuration. A drilling assembly axis 728 and drill bit axis 729 are shown within the drilling assembly 130. Drilling assembly axis 728 represents a central longitudinal axis of the BHA. Drill bit axis 729 represents a central longitudinal axis of the drill bit. The drill bit axis 729 indicates a direction in which the drill bit is drill bit pointed. In the actuated configuration, the drill bit axis 729 is angularly offset from the drilling assembly axis 728 (i.e., forms a non-zero angle with respect to the drilling assembly axis 728). Point 902 indicates a location at which the drilling assembly axis 728 and the drill bit axis 729 intersect when the drilling assembly 130 is actuated. The joint 713 allows for angular flexibility between drill bit 715 and upper housing 710 and allows drilling torque and axial force (weight on bit) to be transmitted from the upper housing 710 to the drill bit 715.

The angular offset is created and dynamically adjusted using the electromechanical actuators 711 to apply a force against the adjuster 712. Reciprocating movement of the electromechanical actuators 711 against the adjuster 712 generates a geostationary tilt angle between the drill bit axis 729 and the drilling assembly axis 728. While the electromechanical actuators 711 have limited power output, they can transfer high load torques and high axial loads through the drilling assembly 130 due to having minimal or low friction between those load-bearing components which move during the reciprocating motion of the adjuster 712 and/or joint 713.

Figure 10:
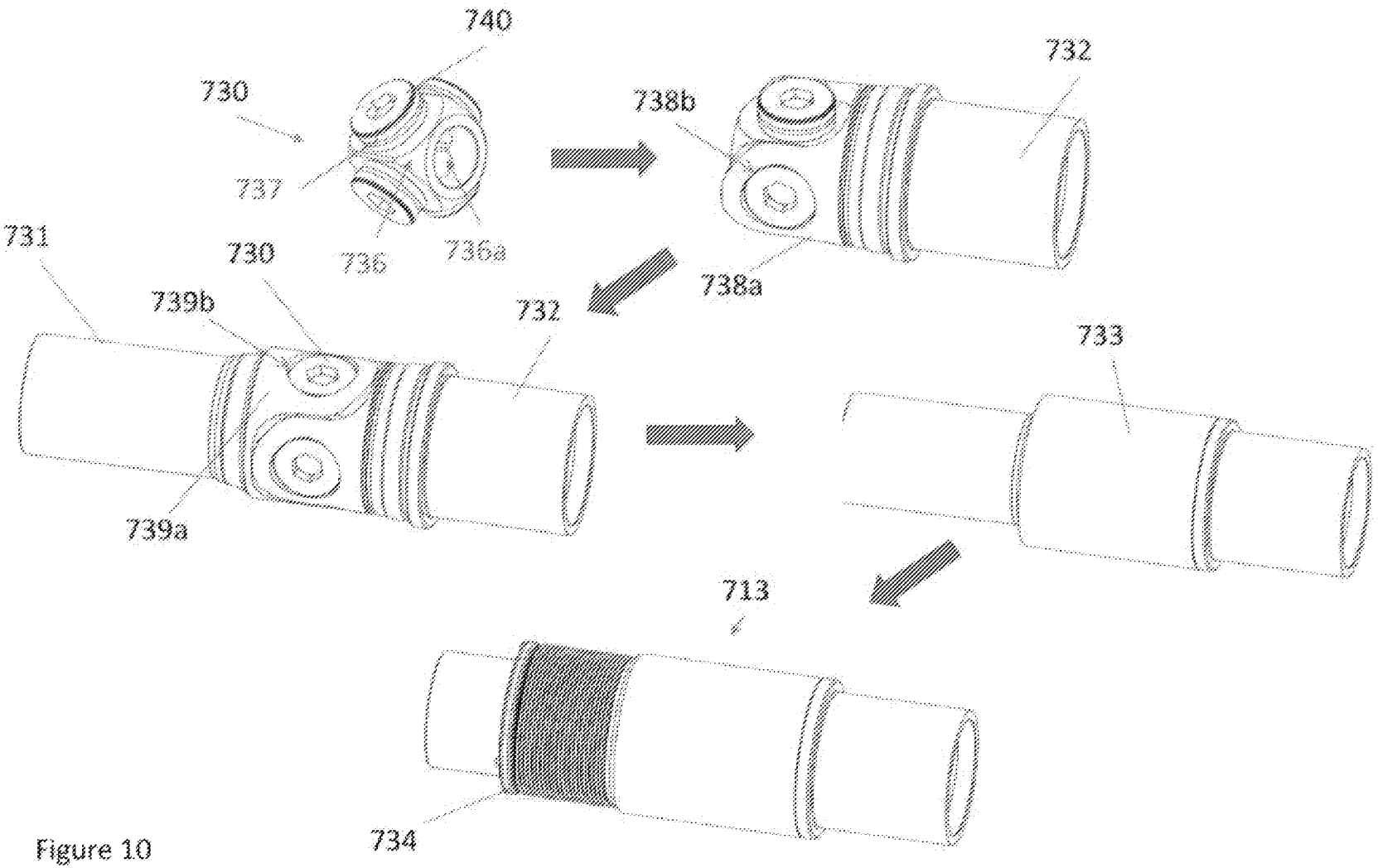
FIG. 10 illustrates an assembly process for a joint.

FIG. 10 illustrates an assembly process for the joint 713. A Cardan element 730 or universal joint element is provided. The Cardan element 730 includes four bolts 740 spaced at 90 degrees from each other around a circumference of the Cardan element 730. Bearings 737 (which can be low friction roller bearings) are carried by or secured to each of the four bolts 740. The four bolts 740 define two axes of the Cardan element 730, both of which are shown perpendicular to each other. When the joint 713 is assembled, these axes are perpendicular to the longitudinal axis of upper connector 731 and lower connector 732, and perpendicular to the longitudinal axis of drilling assembly 130. The two axes of the Cardan element 730 allow lower connector 732 to pitch and yaw, respectively, relative to upper connector 731. While having the axes perpendicular to each other and to the longitudinal axes of upper connector 731, lower connector 732 and drilling assembly 130 is a preferred embodiment, this is not meant to be a limitation of the invention. Respective angles may also be smaller or larger than 90°. The Cardan element 730 is inserted into a lower connector 732 so that two opposing bolts of the Cardan element 730 reside within receiving holes **738*b* formed in arms 738*a* of the lower connector 732. The Cardan element 730 is then inserted into an upper connector 731 so that the two remaining bolts reside within receiving holes 739*b* formed in arms 739*a* of the upper connector 731. A bellows carrier sleeve 733 is then slid over the Cardan element 730 and arms 738*a* and 739*a*. Finally, a bellows 734 is slid into place along the upper connector 731 to couple to the bellows carrier sleeve 733**.

Figure 11:
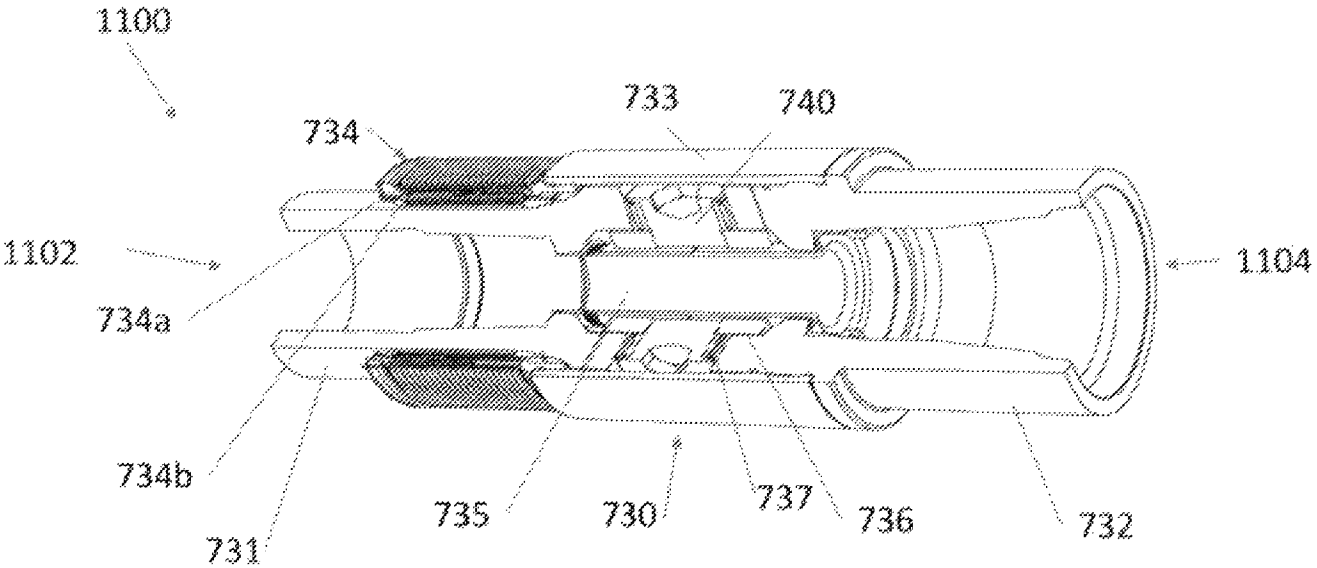
FIG. 11 shows a cutaway view of the joint.

FIG. 11 shows a cutaway view 1100 of the joint 713. The upper connector 731 and the lower connector 732 are shown with the Cardan element 730 therebetween to allow angular rotation between the upper connector 731 and the lower connector 732. Each bolt 740 is secured to center element 736 of Cardan element 730. Center element 736 houses bearings 737, such as plain bearings or roller bearings (comprising roller elements, for example, cylindrical, tapered or spherical rollers) that are joined to their respective bolts 740. Cardan element 730 in combination with bearings 737 allow rotation of upper connector 731 and lower connector 732 about their respective longitudinal axes while simultaneously allowing transfer of torque from upper connector 731 to lower connector 732 and vice versa and transferring of axial load (also known as weight-on-bit) from upper connector 731 to lower connector 732 and vice versa. Since the forces, associated with torque and weight-on-bit are extremely high in drilling applications, the transfer of torque and weight-on-bit will create wear on bearings 737. In one embodiment, the bearings 737 are roller bearings and the roller elements are substantially cylindrically symmetric (and not ball symmetric) elements, such as cylindrical, tapered, or frusto-conical rollers. Cylindrically symmetric roller elements have the benefit that forces associated with torque and weight-on-bit will be distributed over a larger area compared to spherical roller elements, for example, which results in less stress on the roller elements. However, cylindrical roller elements are generally not used in conjunction with ball joints. In contrast, cylindrical roller elements are used when upper connector 731 and lower connector 732 are connected via a Cardan-type connection, such as Cardan element 730, that defines a pitch axis and a yaw axis that allow lower connector 732 to pitch and yaw, respectively, relative to upper connector 731, with the axis of rotation for the cylindrical symmetrical roller elements are parallel to either the pitch axis or the yaw axis.

Drilling torque and axial load is transferred from the two arms **739*a* of the upper connector 731 into the respective bearings of the Cardan element 730 and further into the center element 736. The center element 736 can have a cylindrical outer surface. Alternatively, the outer surface of the center element can include any number of adjoining planar surfaces. The center element 736 guides the load towards the bearings 737. Drilling torque and axial load is thereby transferred from an upper connector 731 to the lower connector 732 through the bearings 737 via a center element 736 and respective bolts 740**.

As shown in FIG. 11, the bellows 734 includes an inner bellows 739 attached to the upper connector 731 and an outer bellows **734*a* coupled to the bellows carrier sleeve 733. The bellows carrier sleeve 733 is coupled to the lower connector 732. The bearings 737 of the joint 713 are sealed off from the environment via the bellows carrier sleeve 733 and bellows 734, which allow angular movement between upper connector 731 and lower connector 732. In one embodiment, an internal seal sleeve 735 through center element opening 736***a* of center element 736 of Cardan element 730 seals off an inside of the joint 713. At the same time, internal sleeve 735 defines an opening through the center of Cardan element 730 that allows fluid, such as drilling fluid 179, 279 to flow through upper connector 731 and lower connector 732 to drill bit 155, 255 for cooling and lubrication purposes. The internal seal sleeve 735 can be designed with materials having a flexibility to allow for the angular deflection. For example, internal seal sleeve 735 can be made of at least one of titanium, plastic, PEEK, copper, alloys of aluminum, magnesium, or bronze, fiber carbon, or any combination of these. Outer diameter of joint 713 is defined by bellows carrier sleeve 733 and cannot be larger than diameter of borehole 110 that is defined by the diameter of drill bit 155, 255. On the other hand, internal sleeve 735 needs a minimum outer diameter to provide for a minimum cross-sectional area that is large enough to allow sufficient drilling fluid flow through joint 713 to drill bit 155, 255. In other words, the diameter of internal sleeve 735 needs to be large enough to provide for a flow resistance of drilling fluid that is low enough in order to effectively cool and lubricate drill bit 155. The space between outer diameter of joint 713 and outer diameter of internal sleeve 735 can be utilized for substantially cylindrically symmetric roller elements. Longer cylindrical symmetrical roller elements are beneficial because forces associated with torque and weight-on-bit are distributed over a larger area compared to smaller roller elements, thereby resulting in less stress on the roller elements. However, since the axis of rotation of cylindrically symmetric roller elements is directed in a radial direction of joint 713, the length of cylindrically symmetric roller elements is limited between outer diameter of joint 713 and outer diameter of internal sleeve 735. For example, the length of cylindrically symmetric roller elements may be smaller than 33%, such as than 25% (e.g. smaller than 20% or 15%) of the outer diameter of joint 713.

Figure 12:
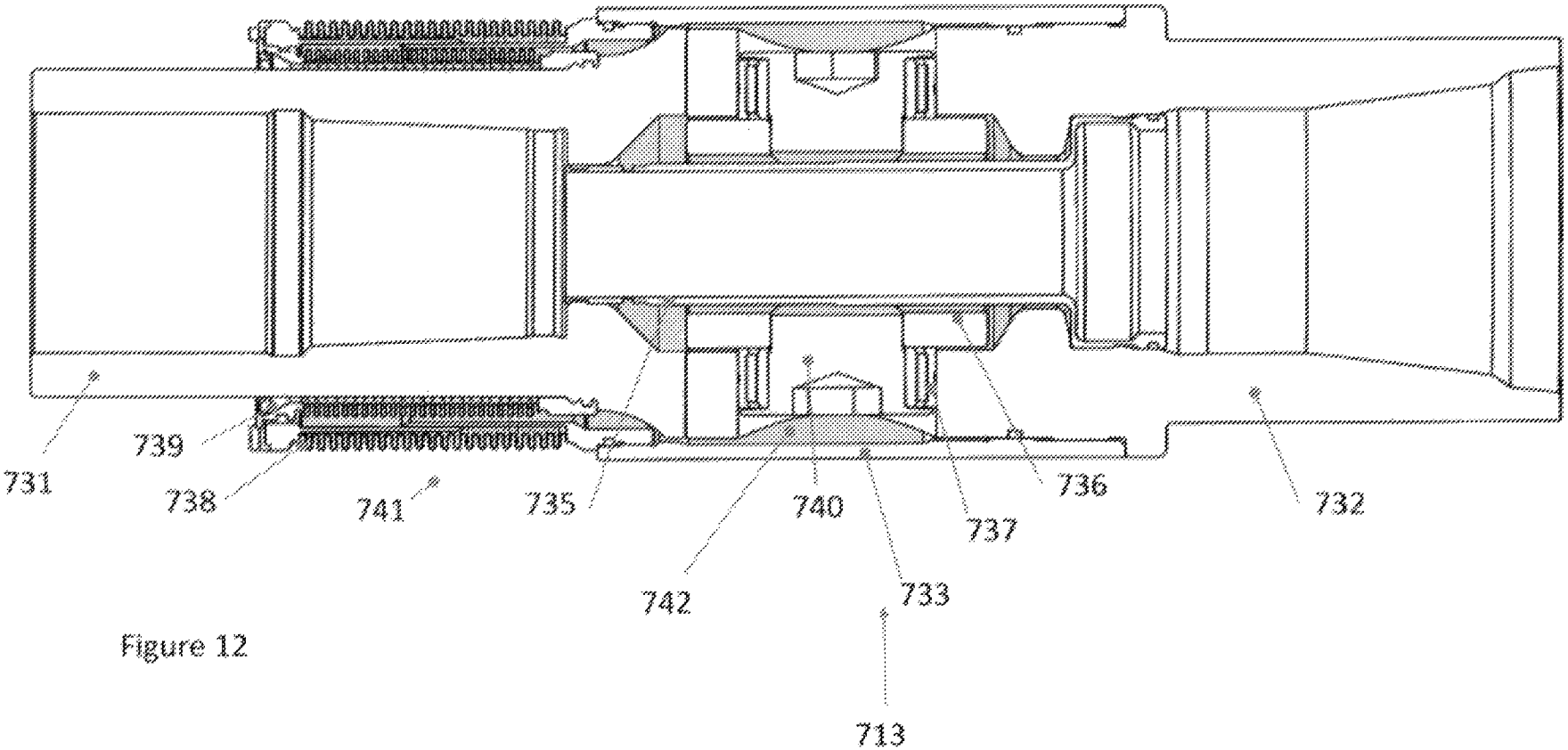
FIG. 12 shows a cross-sectional view of the joint showing an internal lubricant chamber.

FIG. 12 shows a cross-sectional view of the joint 713 showing an internal lubricant chamber 742. A lubricant (e.g., a bearing grease or oil) is stored within the lubricant chamber 742 and is sealed from the environment by the inner bellows 734*b*, the outer bellows 734*a*, the bellows carrier sleeve 733, the upper connector 731, the lower connector 732, and the internal seal sleeve 735. The lubricant allows for a low friction angle adjustment between drilling assembly axis 728 and drill bit axis 729, even in the presence of high drilling torque and axial load. Sealing elements are installed to seal off the various components of joint 713 against each other. Angular movement of the joint 713 is facilitated by the degree of flexibility of the bellows 738 as well as by pressure compensation provided by the lubricant against the pressure of the fluid (i.e., drilling mud 741) outside of the joint 713. While FIG. 12 shows a pressure compensation system utilizing bellows to provide for pressure compensation, other pressure compensation systems, such as those utilizing a movable piston in response to a pressure difference, may be utilized as well for the same purpose.

The low amount of friction in joint 713, in particular if lubricated roller bearings are used, enables the use of the electromechanical actuators to dynamically adjust and correct the axis angle. In downhole applications, electromechanical actuators are powered by either energy storage devices, for example batteries or capacitors, or by energy generated by flow of drilling fluid 179, 279 (for example using turbines), by rotation of tubular member 116 (such as drill pipe) and/or by vibration (e.g. by energy harvesting devices). Typically, the power that can be delivered by such technologies to a downhole location is relatively small. However, when low friction joints (e.g. low friction joints with roller bearings, such as lubricated roller bearings) are used, the power that can be delivered downhole is sufficient for the steering device disclosed herein. In one example, a force applied by one of the three electromechanical actuators 711 is about 1000 N with a respective stroke of approximately 20 mm to actuate the required axis offset of about 1° to create a curvature of about 15° per 100 feet. At a rotary speed of the drill string of approximately 180 rpm, each of the electromechanical actuators 711 performs 3 strokes per second. The actuation power for this example is less than 100 Watt for each actuator and can be provided by standard downhole energy-providing technologies as described above.

Figure 13A:
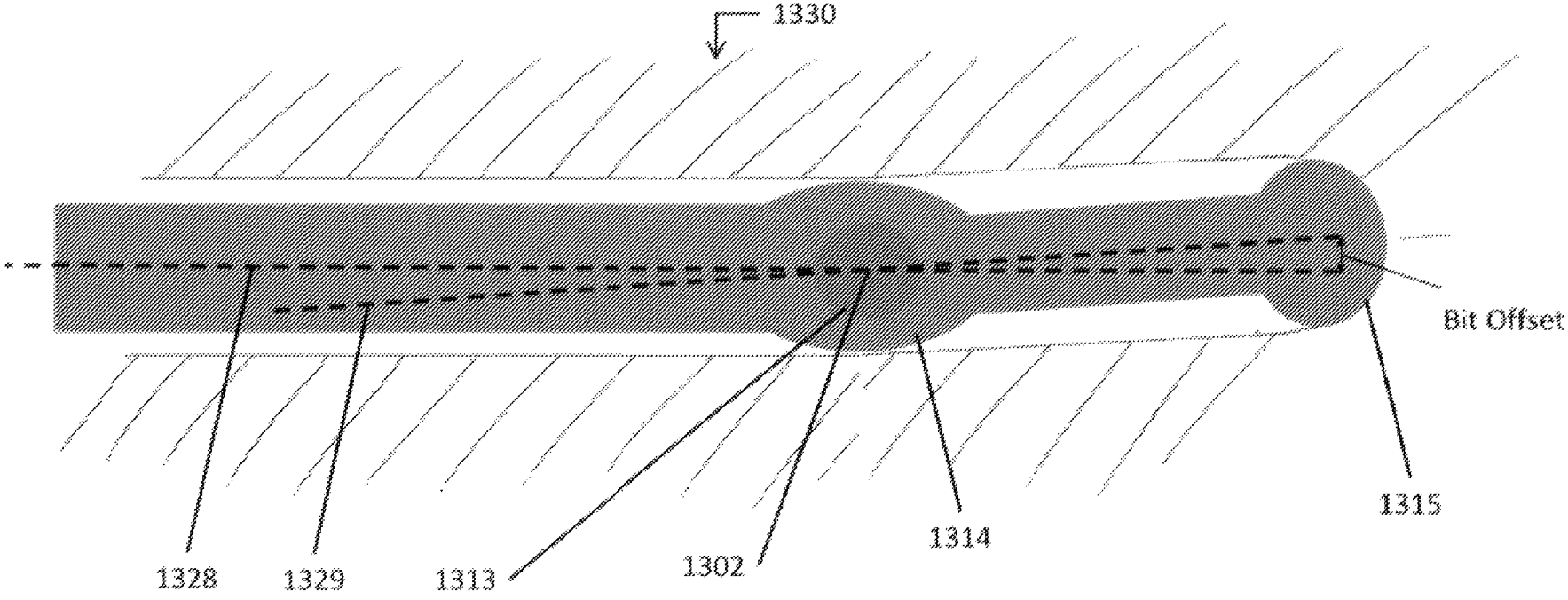
FIG. 13*a*-13*c* show various positions of the joint relative to a stabilizer.
Figure 13B:
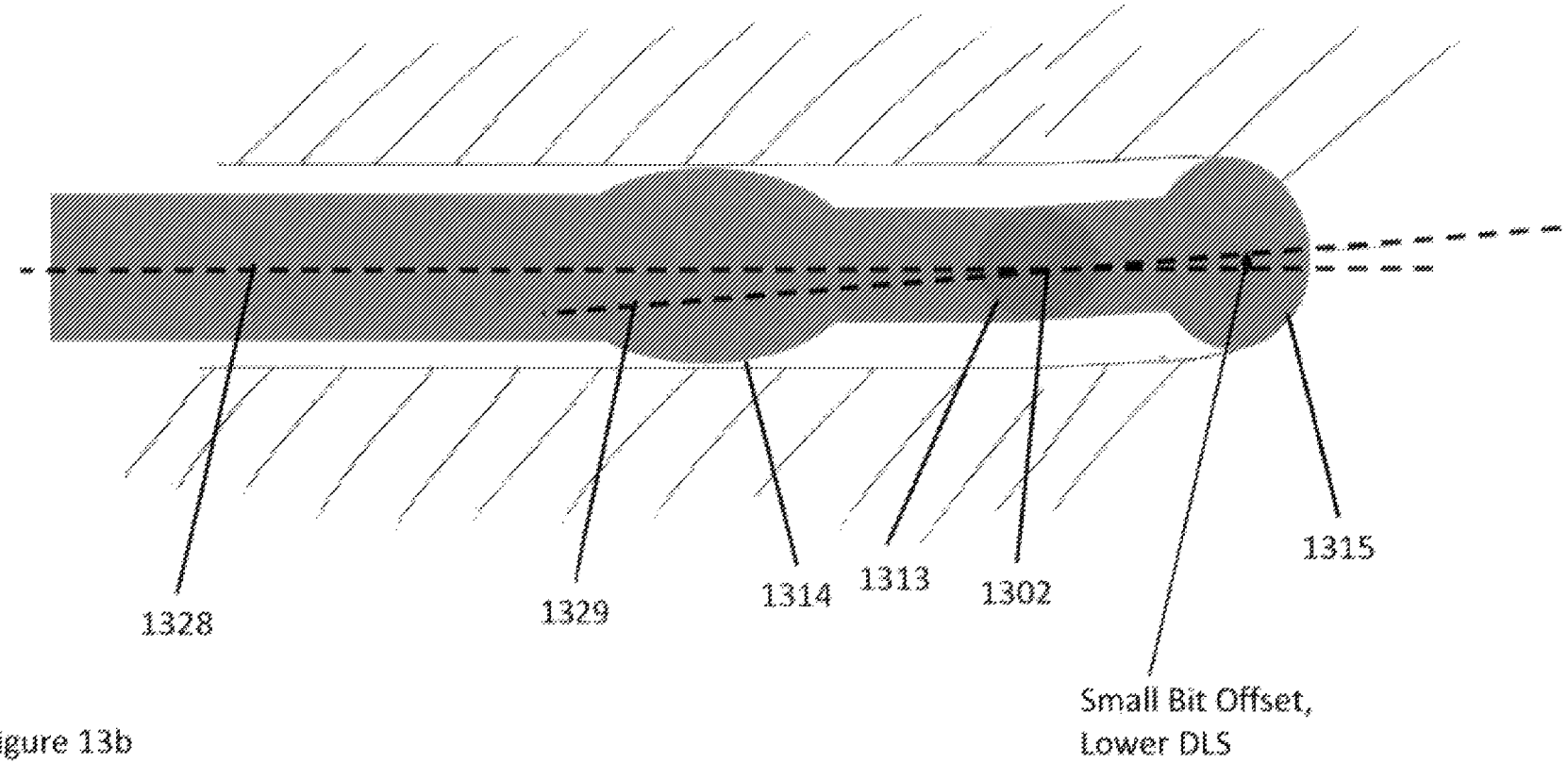
Figure 13C:
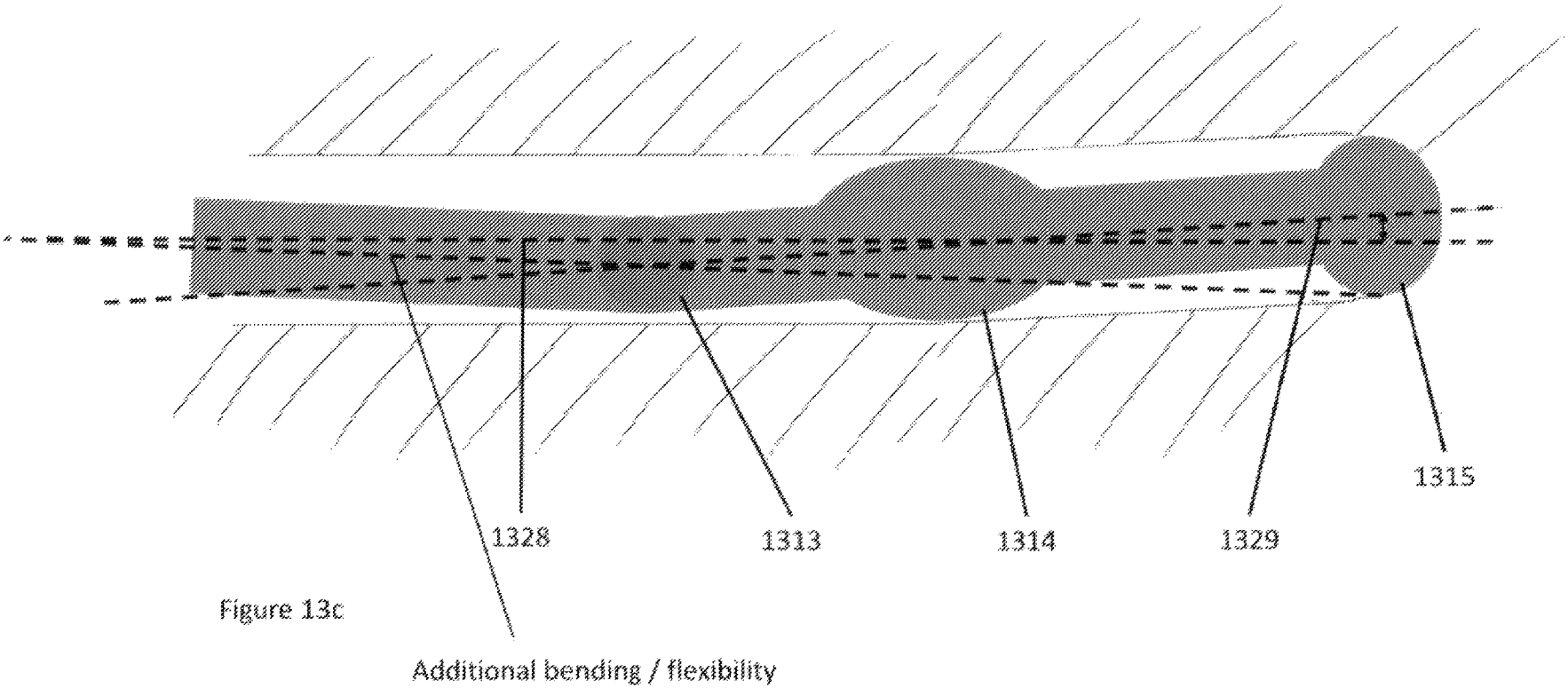

FIGS. 13*a*-13*c* show a joint 1313 (such as joint 713) positioned relative to a stabilizer 1314 (such as stabilizer 714). FIG. 13*a* shows joint 1313 at substantially the same position as stabilizer 1314. In other words, the stabilizer blades of the stabilizer 1314 overlap the location 1302 at which the drilling assembly axis 1328 and the drill bit axis 1329 intersect when drilling assembly 1330 is actuated. FIG. 13*b* shows joint 1313 positioned below or downhole of stabilizer 1314, and FIG. 13*c* shows joint 1313 positioned above or uphole of stabilizer 1314. The position of stabilizer 1314 has several effects. In an embodiment, stabilizer 1314 protects joint 1313, for example, Cardan element 730, inner bellows 734*b*, outer bellows 734*a*, bellows carrier sleeve 733, upper connector 731, and lower connector 732 against wall contact to prevent damage to joint 1313. The closer joint 1313 is to stabilizer 1314, the more the joint 1313 is protected by stabilizer 1314. In one embodiment, as illustrated in FIGS. 13*b*, 13*c*, stabilizer 1314 limits the space that is required to create the angular offset between drilling assembly axis 1328 and drill bit axis 1329. When the distance between joint 1313 and drill bit 1315 is reduced, the dogleg severity (DLS), that can be achieved with an angle between drilling assembly axis 1328 and drill bit axis 1329, is decreased as compared to the setup where the joint 1313 is substantially at the same position of the stabilizer 1314 or above the stabilizer 1314 (as shown in FIG. 13*c*) by the resulting smaller bit offset. However, as a result of the shorter distance (and the smaller bit offset) between the drill bit 1315 and the joint 1313, the available side force at the drill bit 1315 for a given available power of the electromechanical actuator 711, can be higher. A higher side force at the drill bit can be beneficial for initiating a curvature of the borehole from a substantially straight borehole or for more accurate directional control of the well path, especially when drilling in hard rock formation. In another aspect, a greater distance between drill bit 1315 and joint 1313, at a position above the stabilizer 1314, can be selected to create an angle between drilling assembly axis 1328 and drill bit axis 1329 at a position above (i.e., uphole of) stabilizer 1314. Positioning the joint 1313 above (i.e., uphole of) the stabilizer 1314 can have the advantage of a reduction of forces of the electromechanical actuator 711 for certain relations of e. g. borehole diameter (or diameter of drill bit 1315), diameter of stabilizer 1314, distance between stabilizer 1314 and drill bit 1315, distance between drill bit 1315 and joint 1313, or any combination thereof. In some configurations, the forces to drill a curved borehole can be minimal or even zero, thus reducing the power demand of the electromechanical actuators 711. As shown in FIG. 13*c*, the distance between the joint 1313 and the stabilizer 1314 is limited by geometrical constraints of the drilling assembly and the diameter of the borehole. In one embodiment, the distance between stabilizer 1314 and joint 1313 is 2 meters or less. In another embodiment, the angle between the drilling assembly axis 1328 and the drill bit axis 1329 is less than 2 degrees. In another embodiment, joint 1313 is located between stabilizer 1314 and drill bit 1315. In another embodiment, joint 1313 and the stabilizer 1314 is substantially at location 1302 at which the drilling assembly axis 1328 and the drill bit axis 1329 intersect when drilling assembly 1330 is actuated. In some configurations, the stabilizer 1314 (or 714 in FIG. 9) tilts with the drill bit axis 1329.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A drilling assembly for use in drilling of a wellbore, comprising:

a steering device having a tilt device and an actuation device comprising at least two electromechanical actuators, wherein a first section and a second section of the drilling assembly are coupled through the tilt device and wherein the first section is attached to a drill bit, and wherein the actuation device comprises an electromechanical actuator and causes a tilt of the tilt device to cause the first section attached to the drill bit and the drill bit to tilt relative to the second section along a selected first direction while the steering unit is rotating.

2. The drilling assembly of claim 1, wherein the at least two electromechanical actuators selectively operate at least two valves to divert fluid flowing through the drilling assembly to cause the tilting of the first section attached to the drill bit and the drill bit relative to the second section.

3. The drilling assembly of claim 1, further including one or more controllers that control the movement of the at least two electromechanical actuators.

4. The drilling assembly of claim 3, wherein the one or more controllers control the movement of the at least two electromechanical actuators in response to a parameter of interest.

5. The drilling assembly of claim 1, wherein the tilt device comprises a Cardan element coupling the first section to the second section.

6. The drilling assembly of claim 5, wherein the tilt device comprises at least one roller bearing between the Cardan element and at least one of the first section and the second section.

7. The drilling assembly of claim 6, wherein the roller bearing is lubricated by a lubricant.

8. The drilling assembly of claim 7, wherein the lubricant is in a sealed lubrication chamber that is pressure compensated.

9. The drilling assembly of claim 1, further comprising a stabilizer, wherein a distance between the stabilizer and the tilt device is two meters or less.

10. A method of drilling a wellbore, comprising:

conveying a drilling assembly in the wellbore, wherein the drilling assembly includes a drill bit at an end thereof, a steering unit that includes a tilt device and an actuation device, wherein a first section and a second section of the drilling assembly are coupled through the tilt device and wherein the first section is attached to the drill bit, and wherein the actuation device comprises at least two electromechanical actuators and tilts the tilt device to cause the first section attached to the drill bit and the drill bit to tilt relative to the second section about the tilt device along a selected direction while the steering unit is rotating;

drilling the wellbore using the drill bit; and actuating at least one of the electromechanical actuators to tilt the tilt device to cause the first section attached to the drill bit and the drill bit to tilt relative to the second section and to maintain the tilt geostationary while the drilling assembly is rotating to form a deviated section of the wellbore.

11. The method of claim 10 further comprising selectively operating at least two valves by the at least two electromechanical actuators to divert fluid flowing through the drilling assembly to cause the tilting of the first section attached to the drill bit and the drill bit relative to the second section.

12. The method of claim 10, further including one or more controllers that control the movement of the at least two electromechanical actuators.

13. The method of claim 12, wherein the one or more controllers control the movement of the at least two electromechanical actuators in response to a parameter of interest.

14. The method of claim 10, wherein the tilt device comprises a Cardan element coupling the first section to the second section.

15. The method of claim 14, wherein the tilt device comprises at least one roller bearing between the Cardan element and at least one of the first section and the second section.

16. The method of claim 15, further comprising lubricating the roller bearing by a lubricant.

17. The method of claim 16, further comprising sealing the lubricant in a lubrication chamber that is pressure compensated.

18. The method of claim 10, wherein the drilling assembly further comprises a stabilizer, further comprising tilting the tilt device at a distance of two meters or less from the stabilizer.

19. A drilling assembly for use in drilling of a wellbore, comprising:

a steering device having a tilt device and an actuation device, wherein a first section and a second section of the drilling assembly are coupled through the tilt device and wherein the first section is attached to a drill bit, wherein the tilt device comprises a Cardan element coupling the first section to the second section;

wherein the tilt device comprises at least one roller bearing between the Cardan element and at least one of the first section and the second section; and wherein the actuation device comprises an electromechanical actuator and causes a tilt of the tilt device to cause the first section attached to the drill bit and the drill bit to tilt relative to the second section along a selected first direction while the steering unit is rotating.

20. A method of drilling a wellbore, comprising:

conveying a drilling assembly in the wellbore, wherein the drilling assembly includes a drill bit at an end thereof, a steering unit that includes a tilt device and an actuation device, wherein a first section and a second section of the drilling assembly are coupled through the tilt device and wherein the first section is attached to the drill bit, wherein the tilt device comprises a Cardan element coupling the first section to the second section, wherein the tilt device comprises at least one roller bearing between the Cardan element and at least one of the first section and the second section, and wherein the actuation device comprises an electromechanical actuator and tilts the tilt device to cause the first section attached to the drill bit and the drill bit to tilt relative to the second section about the tilt device along a selected direction while the steering unit is rotating;

drilling the wellbore using the drill bit; and actuating the electromechanical actuators to tilt the tilt device to cause the first section attached to the drill bit and the drill bit to tilt relative to the second section and to maintain the tilt geostationary while the drilling assembly is rotating to form a deviated section of the wellbore.

* * * * *